United States Patent [19]

Holmes

[11] 4,239,051

[45] Dec. 16, 1980

[54] INTEGRALLY-FORMED POLYMERIC MATERIAL COIN HOLDER

[75] Inventor: Gordon W. Holmes, Mississauga, Canada

[73] Assignee: Professional Packaging Limited, Mississauga, Canada

[21] Appl. No.: 971,335

[22] Filed: Dec. 20, 1978

[30] Foreign Application Priority Data

Dec. 23, 1977 [FR] France ..... 53852/77

[51] Int. Cl.[3] ..... G07D 9/00

[52] U.S. Cl. ..... 133/8 R

[58] Field of Search ..... 133/1 A, 8 R, 1 R, 8 A; 206/0.82, 0.84; 220/339

[56] References Cited

U.S. PATENT DOCUMENTS

| | | | |
|---|---|---|---|
| 1,076,400 | 10/1913 | Wilton | 206/0.82 |
| 3,402,806 | 9/1968 | Sutherland et al. | 206/0.82 |
| 4,049,115 | 9/1977 | Pasbrig | 206/0.84 |
| 4,095,608 | 6/1978 | Holmes | 133/8 R |

FOREIGN PATENT DOCUMENTS

| | | | |
|---|---|---|---|
| 636290 | 10/1936 | Fed. Rep. of Germany | 206/0.82 |

*Primary Examiner*—Stanley H. Tollberg

[57] ABSTRACT

An integrally-formed coin holder useful for the packaging and dispensing of predetermined numbers of coins has a generally C-shaped cross-section elongate body, lips at the mouth of the body and end closures defining generally C-shaped openings in each end of the body. The coin holder includes elongate bar-like panels extending from end to end and longitudinally-spaced radial ribs interconnecting the bars and the remainder of the body.

6 Claims, 10 Drawing Figures

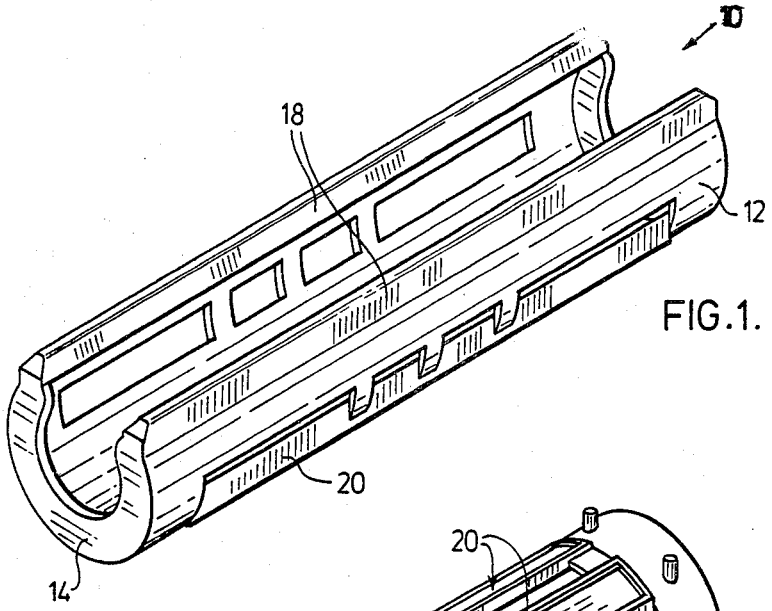
FIG.1.
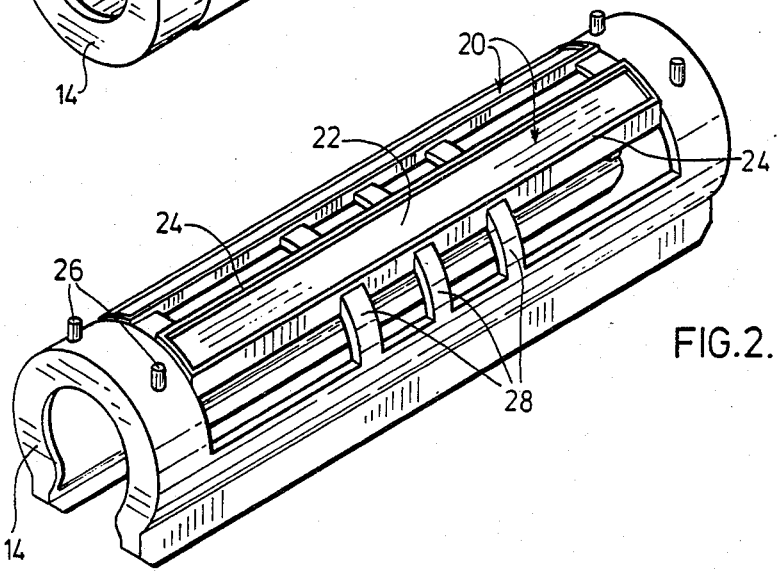
FIG.2.
FIG.3.
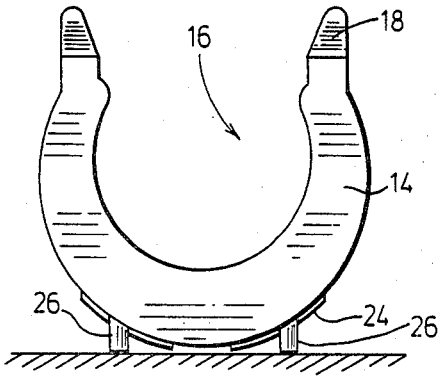

INTEGRALLY-FORMED POLYMERIC MATERIAL COIN HOLDER

FIELD OF INVENTION

The present invention relates to a holder for disc-like objects.

BACKGROUND OF THE INVENTION

In my U.S. Pat. No. 4,095,608, the disclosure of which is incorporated herein by reference, there is described a holder for disc-like objects, such as, coins, integrally formed of flexible polymeric material, which comprises an elongate body having a generally C-shaped cross-section and a radius of curvature substantially equal to the radius of the disc-like objects and an end wall integral with the body at each end thereof. The end walls define a generally C-shaped opening in the ends of the body of smaller radius of curvature than that of the body. The holder is capable of limited flexure about its axis to allow for insertion and removal of the coins through the curvilinear extremities of the body by expansion of the linear distance between the curvilinear extremities beyond the diameter of the disc-like objects.

SUMMARY OF INVENTION

The present invention is directed to a number of modifications to the coin holder of the prior structure.

BRIEF DESCRIPTION OF DRAWINGS

FIG. 1 is a perspective view from one side of a first modified form of coin holder;

FIG. 2 is a perspective view from the other side of the coin holder of FIG. 1;

FIG. 3 is an end view of the coin holder of FIG. 1;

Referring to the drawings, FIGS. 1 to 3 illustrate a first modification of the coin holder of my earlier patent. A coin holder 10, which also may be used for other disc-like objects, has a hollow body portion 12 of generally C-shaped cross-section and end walls 14 which define a C-shaped opening 16 in the ends of the body portion 12 of diameter less than that of the body portion 12.

Figure 4:
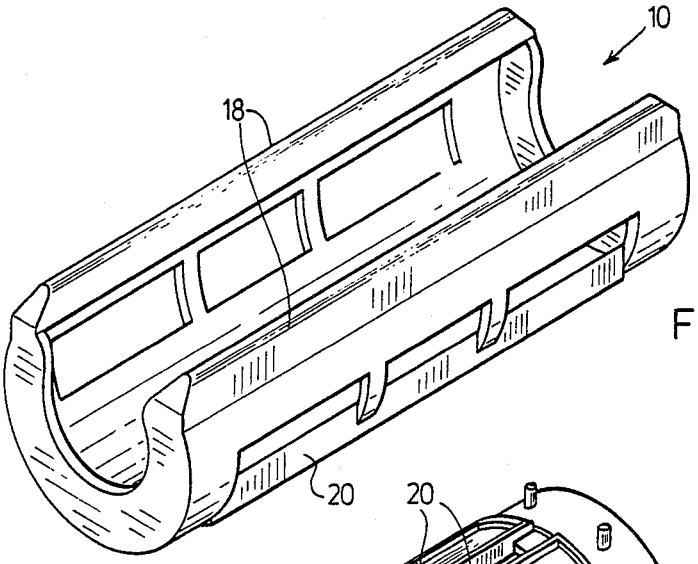
FIG. 4 is a perspective view from one side of a second modified form of coin holder.

The end walls 14 are generally crescent-shaped so that the center of curvature of the opening 16 is offset from the center of curvature of the body portion 12. The curvilinear extremities of the body portion 12 are provided with triangularly cross-sectioned lips 18 which have parallel outer surfaces and diverging inner faces.

The triangular shape of the lips 18 assists in the insertion of coins into and the removal of coins from the holder 10, as described in detail in my prior patent.

The end walls 14 provide a considerable spring grip strength to the holder 10 as compared to the body 12 above. The contouring of the end walls 14 as described above assists in this result, as set forth in detail in my prior patent.

Two continuous elongate bars 20 extend in parallel spaced-apart fashion along the length of the body 12 from adjacent the respective end walls. Each of the bars 20 has a recessed surface 22 and an outer perimeter 24 which is raised with respect to the remainder of the outer surface of the body 12, as may clearly be seen in FIGS. 2 and 3.

The recessed nature of the surface 22 permits lettering and/or numbering to be positioned thereon in bold relief without the lettering and/or numbering extending beyond the upper extremity of the perimeter. This provides a very strong visual impact with respect to the information conveyed by the lettering and/or numbering.

The raised nature of the outer perimeter 24 in addition to emphasizing the bold relief of the lettering and numbering while not interfering the smooth continuity of the internal surface of the body 12 also assists in positioning the coin holder 10 in a relatively stable position on a horizontal surface.

The body 12 is provided with pairs of projections 26 adjacent each end thereof and opposite to the opening through which the coins are received, which act as feet for the holder 10. When positioned on a horizontal surface, as seen in FIG. 3, the adjacent edges of the perimeters 24 of the elongate bars 20 also engage the horizontal surface and assist in inhibiting rolling of the holder 10 on the horizontal surface.

The body 12 also includes three ribs 28 which extend circumferentially with respect to the body 12 and join the sides of the bars 20 to each other and to the body 12. The three ribs 28 are clustered adjacent the midsection of the length of the coin holder 10.

The elongate bars 20 and the ribs 28 combine to provide an open latticework appearance to the body 12, so that coins can be observed therethrough. The latticework appearance also assists in the removal of coins from the holder 10, as discussed in more detail below.

Figure 5:
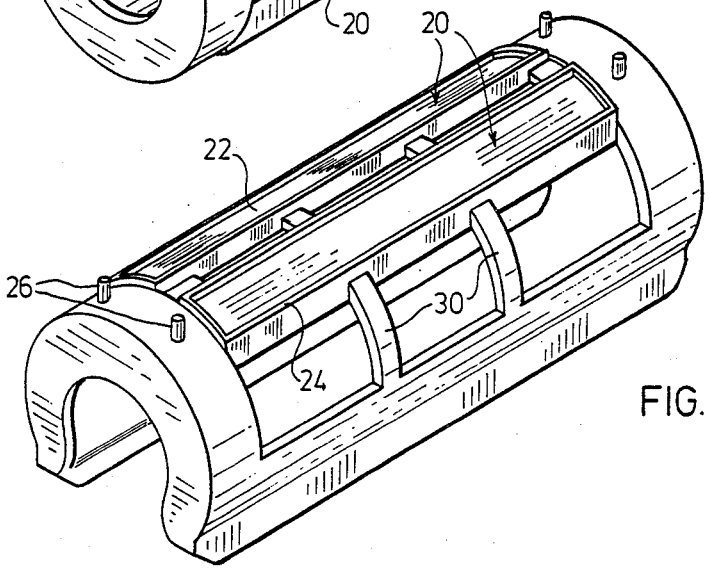
FIG. 5 is a perspective view from the other side of the coin holder of FIG. 4.

In the modification of FIGS. 4 and 5, the structure of the coin holder 10 is very similar to that described with respect to the embodiment of FIGS. 1 to 3, except that the holder is designed to accommodate larger diameter coins in lesser number than in the case of the embodiment of FIGS. 1 to 3, and two ribs 30 are used in place of the three ribs 28.

The ribs 30 separate the space between the body ends into three substantially equal length parts and are not clustered adjacent the midsection of the coin holder as they are in the case of FIGS. 1 to 3.

Figure 8:
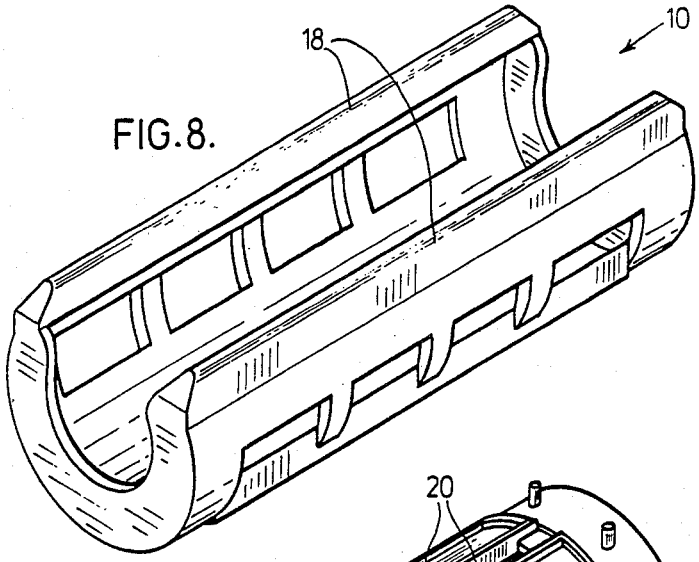
FIG. 8 is a perspective view from one side of a fourth modified form of coin holder.
Figure 9:
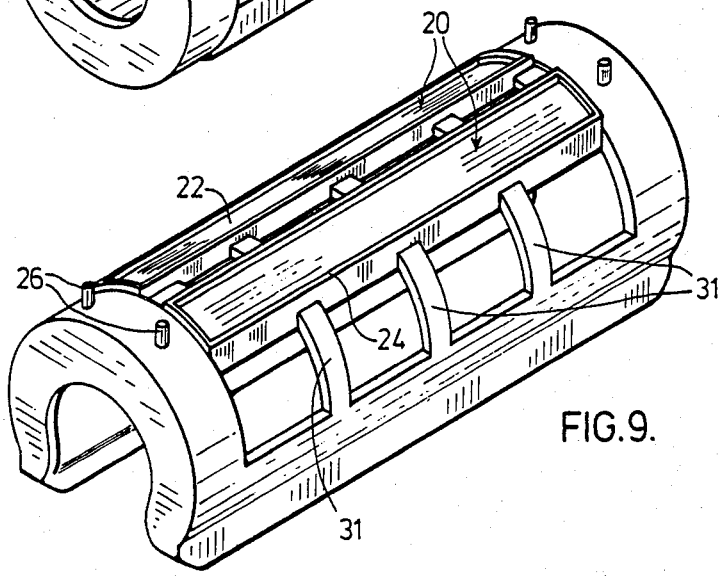
FIG. 9 is a perspective view from the other side of the coin holder of FIG. 8.

In the modification of FIGS. 8 and 9, the structure of the coin holder 10 is very similar to that of FIGS. 4 and 5, except that three equally-spaced ribs 31 are provided between the ends in place of the two ribs of FIG. 5. This modification is intended to accommodate larger diameter coins that in the case of the embodiment of FIGS. 1 to 3 of intermediate number between the FIGS. 1 to 3 embodiment and the FIGS. 4 and 5 embodiment.

The latticework which is provided by the elongate bars 20 and the ribs 28,30 and 31 imparts a flexibility to the body 12 of the holder 10 which assists in the removal of coins from the holder 10 by the procedure of turning the holder 10 upside down, pulling outwardly on the lips 18 using finger tips and pushing down on the latticework using the thumbs. The latticework will deform under the pressure of the thumbs and, once the coins have been ejected, release of the thumb pressure allows restoration of the latticework to its original position.

In the case of the modification of FIGS. 1 to 3, and FIGS. 8 and 9, the third rib 28 or 31 located between the outer two ribs 28 or 31 imparts added strength in the region where thumb application occurs.

In the case of the modification of FIGS. 4 and 5, the additional rib is not required, since the longitudinal dimension of the holder 10 and the number of coins to be packaged are less. Thus, the modification of FIGS. 1 to 3 may be used to package 50×1¢ coins, the modification of FIGS. 4 and 5 may be used to package 40×25¢ coins and the modification of FIGS. 8 and 9 may be used to package 40×5¢.

Figure 6:
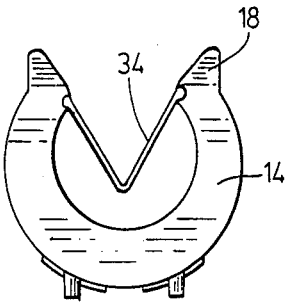
FIG. 6 is an end view of a third modified form of coin holder in a first position.
Figure 7:
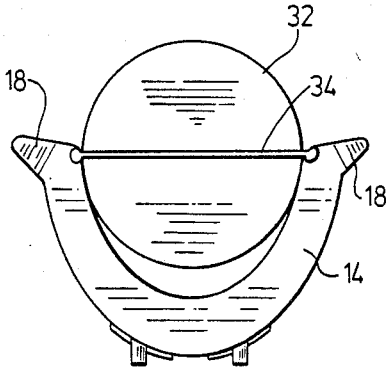
FIG. 7 is the end view of the third modified form of coin holder in a second position.

Turning now to the third modification illustrated in FIGS. 6 to 7, these are respectively end views of the coin holder 10 in its relaxed or closed position and in its strained or opened position. As mentioned in my prior patent, coins are inserted into and removed from the coin holder by expanding the rectilinear dimension between the lips 18 to a value greater than the diameter of the coin 32 or other disc-like object.

Although the coin holder 10 may be filled, emptied and refilled again a multiple number of times without fatigue, it is possible to overstrain the holder 10 by expanding the rectilinear dimension between the lips to a value substantially greater than the coin diameter and thereby impair the ability of the coin holder 10 to be used a multiple number of times.

To guard against such action, each end wall 14 of the coin holder 10 in the modification of FIGS. 6 and 7 is provided with an integrally-formed end rib 34 which prevents the linear dimension between the lips from being expanded a distance no more than a minor amount greater than the diameter of the coin. In this way, overstraining of the coin holder is prevented. The rib 34 lies just beyond the linear extremity of the body 12 so that the holder 10 may readily be molded as a single piece.

Figure 10:
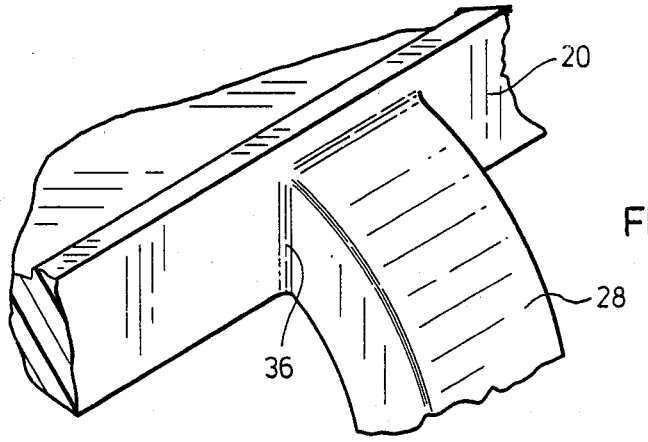
FIG. 10 is a close-up view of a portion of any one of the coin holders.

As may be seen in FIG. 10, corners at each integral position of rib 28 and bar 20, and the rest of the body (not shown), are rounded at 36 to prevent breakage along a potential line of weakness, if a sharp corner is provided, and the holder is subjected to shock or a sharp hit.

SUMMARY OF DISCLOSURE

In this disclosure, there are described a number of modifications which may be effected to the coin holder of my prior patent while retaining the versatility and utility thereof. Other modifications are possible within the scope of the invention.

I claim:

1. An integrally-formed holder for disc-like objects constructed of flexible polymeric material and comprising:

an elongate body having a generally C-shaped cross-section and a radius of curvature substantially equal to the radius of the disc-like objects, and a continuous end wall integral with said body at each end thereof, said end walls defining a substantially C-shaped opening in each end of said body of smaller radius of curvature than the radius of curvature of said body with the C-shaped end openings encompassing the axis of said body within their periphery, said body having an open latticework constituted by at least two radial ribs and two longitudinal bar-like members located in parallel radially-spaced relationship one on each side of the axis of the body, each of said bar elements having a recessed surface and a perimeter extending slightly outwardly from the surface of the body, said holder being capable of limited resilient flexure about the axis of said body to increase the radii of curvature of said body and said end wall openings to permit insertion and removal of the disc-like objects through said curvilinear extremities, said end walls exerting a resilient force on said body during said flexure and said increase of radii of curvature urging said body to assume said radius of curvature substantially equal to the radius of said disc-like objects.

2. The holder of claim 1, wherein two of said bar-like elements are provided located in parallel radially-spaced relationship with each other, and each of said bar-like elements has a recessed surface and a raised perimeter.

3. The holder of claim 1, wherein two of said radial ribs are provided located in equally spaced relationship with each other and with the longitudinal ends of the body.

4. The holder of claim 1, wherein three of said ribs are provided located in equally spaced relationship with each other and with the longitudinal ends of the body.

5. An integrally-formed holder for disc-like objects constructed of flexible polymeric material and comprising:

an elongate body having a generally C-shaped cross-section and a radius of curvature substantially equal to the radius of the disc-like objects, and a continuous end wall integral with said body at each end thereof, said end walls defining a substantially C-shaped opening in each end of said body of smaller radius of curvature than the radius of curvature of said body with the C-shaped end openings encompassing the axis of said body within their periphery, said holder being capable of limited resilient flexure about the axis of said body to increase the radii of curvature of said body and said end wall openings to permit insertion and removal of the disc-like objects through said curvilinear extremities, said end walls exerting a resilient force on said body during said flexure and said increase of radii of curvature urging said body to assume said radius of curvature substantially equal to the radius of said disc-like objects, and flexure limiting means integrally connected to the outer face of said end walls and extending across said C-shaped end opening between opposed parts of said end wall, said flexure limiting means preventing increase in the radii of curvature of said body and said end wall openings substantially beyond the diameter of said disc-like objects.

6. The holder of claim 1 wherein each integral joining of said radial ribs and said longitudinal bar with each other and the remainder of the body is provided with convexly-rounded corners.

* * * * *